US009913501B1

(12) United States Patent
Flug

(10) Patent No.: US 9,913,501 B1
(45) Date of Patent: Mar. 13, 2018

(54) METHODS OF REDUCING IMPACT FORCES AND INJURIES USING A SYNTHETIC NECK MUSCLE SYSTEM

(71) Applicant: ATHLETEK SPORTS SAFETY GEAR LLC, Lindstrom, MN (US)

(72) Inventor: Brian Charles Flug, Lindstrom, MN (US)

(73) Assignee: ATHLETEK SPORTS SAFETY GEAR LLC, Lindstrom, MN (US)

( * ) Notice: Subject to any disclaimer, the term of this patent is extended or adjusted under 35 U.S.C. 154(b) by 229 days.

(21) Appl. No.: 14/918,216

(22) Filed: Oct. 20, 2015

Related U.S. Application Data

(63) Continuation-in-part of application No. 13/660,997, filed on Oct. 25, 2012, now abandoned, and a continuation-in-part of application No. 14/324,441, filed on Jul. 7, 2014, now abandoned.

(60) Provisional application No. 61/612,036, filed on Mar. 16, 2012.

(51) Int. Cl.
*A41D 13/05* (2006.01)
*A41D 31/00* (2006.01)

(52) U.S. Cl.
CPC ..... *A41D 13/0512* (2013.01); *A41D 31/0016* (2013.01)

(58) Field of Classification Search
CPC ..... A41D 13/0512; A41D 13/0016
USPC ..... 2/468; 128/845; 602/17, 18
See application file for complete search history.

(56) References Cited

U.S. PATENT DOCUMENTS

| | | | | |
|---|---|---|---|---|
| 2,806,471 | A | 9/1957 | Breese | |
| 3,024,784 | A | 3/1962 | Monfardini | |
| 3,189,917 | A | 6/1965 | Sims | |
| 3,320,950 | A | 5/1967 | Mcelvenny | |
| 3,497,872 | A | 3/1970 | Travis | |
| 3,657,739 | A * | 4/1972 | Holmes, Sr. | A41D 13/0512 2/467 |
| 3,668,706 | A | 6/1972 | Velasquez | |
| 3,850,164 | A * | 11/1974 | Hare | A61F 5/055 128/DIG. 23 |
| 3,855,631 | A | 12/1974 | Ettinger | |
| 3,964,474 | A | 6/1976 | Fox | |
| 4,205,667 | A * | 6/1980 | Gaylord, Jr. | A61F 5/055 128/DIG. 23 |
| 4,338,685 | A | 7/1982 | LaPorta, Jr. | |
| 4,401,111 | A | 8/1983 | Blackstone | |
| 4,449,251 | A | 5/1984 | Gauthier | |
| 4,501,023 | A | 2/1985 | Bilberry | |
| 4,686,710 | A | 8/1987 | Marston | |
| 4,821,339 | A | 4/1989 | Fair | |
| 4,881,529 | A | 11/1989 | Santos | |
| 4,996,720 | A | 3/1991 | Fair | |
| 5,275,581 | A | 1/1994 | Bender | |
| 5,334,442 | A | 8/1994 | Okamoto et al. | |

(Continued)

FOREIGN PATENT DOCUMENTS

JP H1133143 A 2/1999

*Primary Examiner* — Katherine Moran

(57) ABSTRACT

A method utilizing a synthetic neck muscle system for minimizing risk of an injury when the system is worn by a user. An impact-absorbing layer of the system is constructed from a core material having a fiber-reinforced foam with a plurality of microspheres located therein. A shell frame of the system has a shell material having a fiber-reinforced putty. The system is molded into a C-shaped structure to be wrapped around the user's neck.

19 Claims, 9 Drawing Sheets

(56) References Cited

U.S. PATENT DOCUMENTS

| | | | |
|---|---|---|---|
| 5,404,590 | A | 4/1995 | Monica, Jr. |
| 5,483,698 | A | 1/1996 | Douglas, Jr. |
| 5,493,736 | A | 2/1996 | Allison |
| 5,546,601 | A | 8/1996 | Abeyta |
| 5,575,410 | A | 11/1996 | Compton |
| 5,737,774 | A | 4/1998 | Petty-Saphon et al. |
| 5,891,069 | A | 4/1999 | Moffett |
| 5,904,662 | A | 5/1999 | Myoga |
| 5,976,098 | A | 11/1999 | Sereboff |
| 6,058,517 | A | 5/2000 | Hartunian |
| 6,067,665 | A | 5/2000 | DePalma et al. |
| 6,481,026 | B1 | 1/2002 | Thomas |
| 6,874,170 | B1 | 4/2005 | Aaron |
| D519,639 | S | 4/2006 | Follman |
| D555,836 | S | 11/2007 | Foust et al. |
| D582,045 | S | 12/2008 | James |
| 7,861,326 | B2 | 1/2011 | Harty |
| 8,002,723 | B2 | 8/2011 | Leatt |
| 8,151,371 | B2 | 4/2012 | Carpentier |
| 8,370,968 | B2 | 2/2013 | Kerr |
| 8,615,819 | B2 | 12/2013 | Kerr |
| 2004/0078877 | A1 | 4/2004 | Harty |
| 2005/0133042 | A1 | 6/2005 | Zikria |
| 2005/0166303 | A1 | 8/2005 | Aaron |
| 2007/0107778 | A1 | 5/2007 | Bettin et al. |
| 2007/0163032 | A1 | 7/2007 | Kerr |
| 2008/0201831 | A1 | 8/2008 | Ronco |
| 2009/0025127 | A1 | 1/2009 | McFie et al. |
| 2009/0044314 | A1 | 2/2009 | Newman |
| 2009/0126085 | A1 | 5/2009 | Gale |
| 2009/0191989 | A1 | 7/2009 | Lammer et al. |
| 2010/0088808 | A1 | 4/2010 | Rietdyk et al. |
| 2010/0122404 | A1 | 5/2010 | Bowlus et al. |
| 2010/0192290 | A1 | 8/2010 | Husain |
| 2010/0221521 | A1 | 9/2010 | Wagner et al. |
| 2011/0010829 | A1 | 1/2011 | Norman |

* cited by examiner

METHODS OF REDUCING IMPACT FORCES AND INJURIES USING A SYNTHETIC NECK MUSCLE SYSTEM

CROSS REFERENCE

This application is a continuation-in-part and claims benefit of U.S. non-provisional patent application Ser. No. 13/660,997, filed Oct. 25, 2012, which is a non-provisional of U.S. provisional application Ser. No. 61/612,036 filed Mar. 16, 2012, and claims priority to U.S. non-provisional patent application Ser. No. 14/324,441 filed on Jul. 7, 2014, the specification(s) of which is/are incorporated herein in their entirety by reference.

FIELD OF THE INVENTION

The present invention relates to personal protective equipment used on a wearer, or more specifically, a dilatant material used in personal protective equipment that simulates the appearance, shape, and function of a human muscle in protecting the wearer against injuries caused by impact or overloading the musculoskeletal system, while easily conforming to the contours of the protected area of the wearer.

BACKGROUND OF THE INVENTION

Personal protective equipment of various sorts has been around for many years. Familiar examples include such things as helmets, back supports, gloves, safety glasses, knee braces, mouth guards, and ankle wraps. Certain occupations and sports participation necessitate the use of personal protective equipment. Although certain advances have been made in the field with the advent of space age materials such as carbon fiber and memory foam replacing some of the older materials developed before the 1960s, there still remains a need for continued improvement as evidenced by the alarming number of occupational and sports injuries still occurring. The present invention features a synthetic neck muscle system for minimizing a risk of an injury, when worn by a wearer.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a synthetic neck muscle system for minimizing a risk of an injury, when worn by a wearer. In some embodiments, the system comprises a core material comprising a fiber-reinforced foam. In some embodiments, a plurality of microspheres is located therein. In some embodiments, the system comprises a shell material encapsulating and bonded to the core material. In some embodiments, the shell material comprises a fiber-reinforced putty. In some embodiments, the system is molded into a form.

DESCRIPTION OF PREFERRED EMBODIMENTS

Figure 1A:
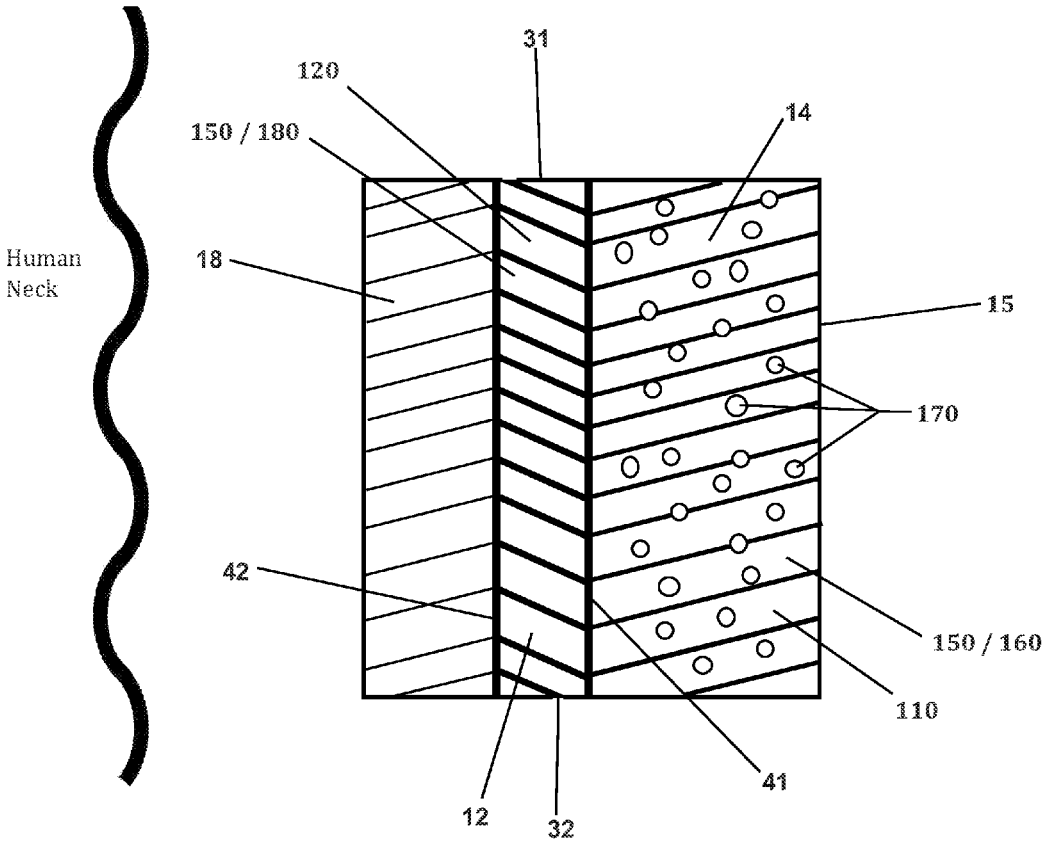
FIG. 1A shows a cross-sectional view of a skin-side memory foam layer, a shell frame, and an impact-absorbing layer according to an embodiment of the present invention.
Figure 1B:
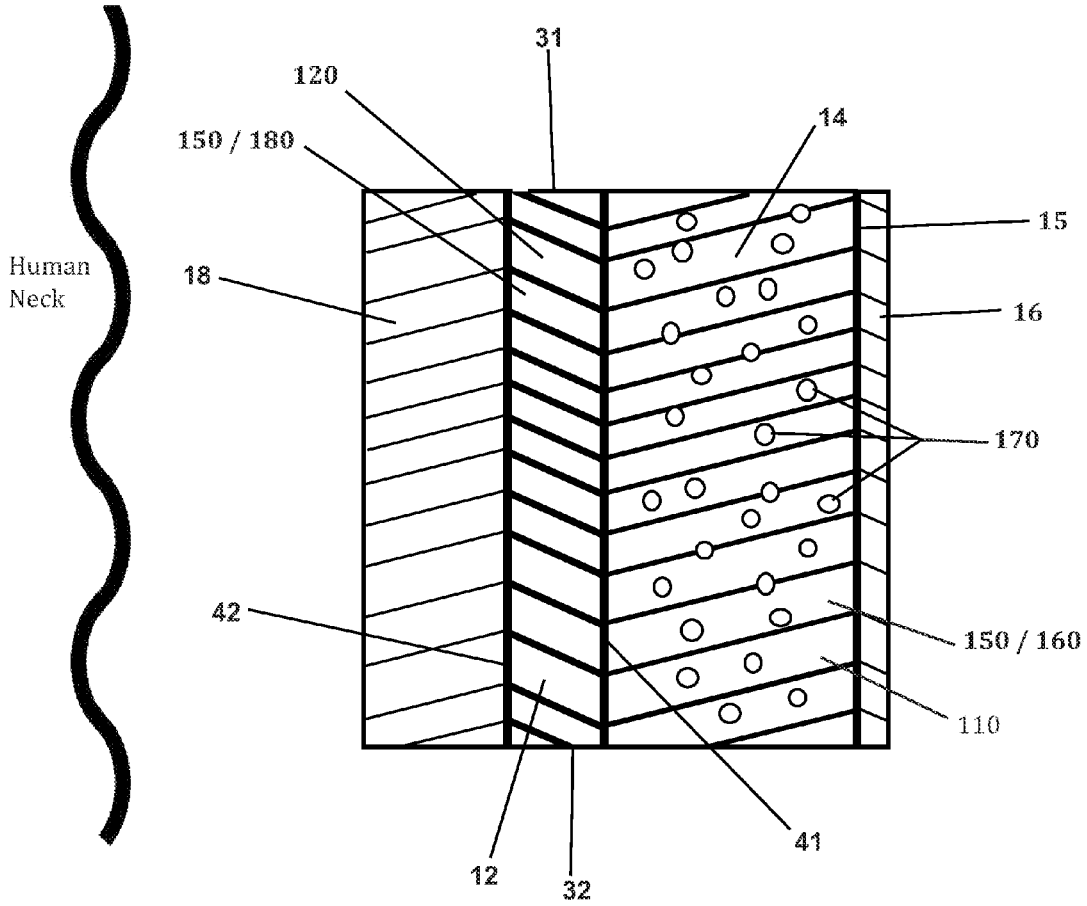
FIG. 1B shows a cross-sectional view of the skin-side memory foam layer, the shell frame, the impact-absorbing layer, and a tension and stabilizer strap according to an embodiment of the present invention.
Figure 2:
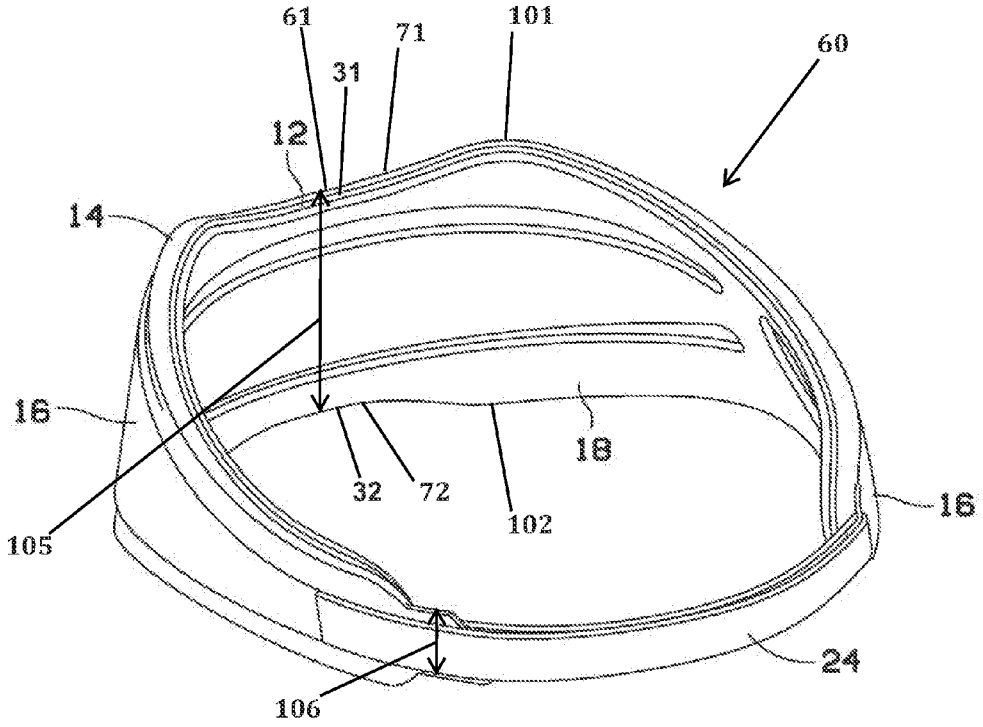
FIG. 2 shows a front perspective view of the present invention.
Figure 3:
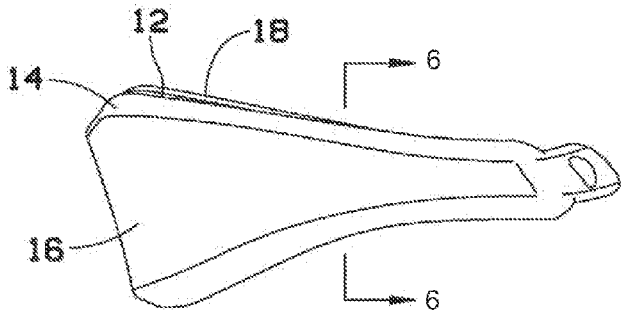
FIG. 3 shows a side view of the present invention.
Figure 4:
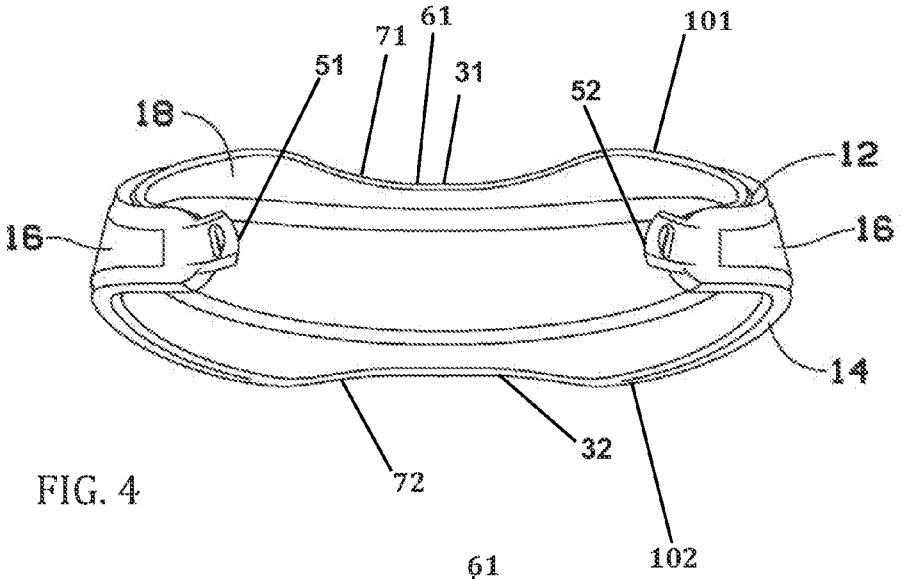
FIG. 4 shows a front view of the present invention.
Figure 5:
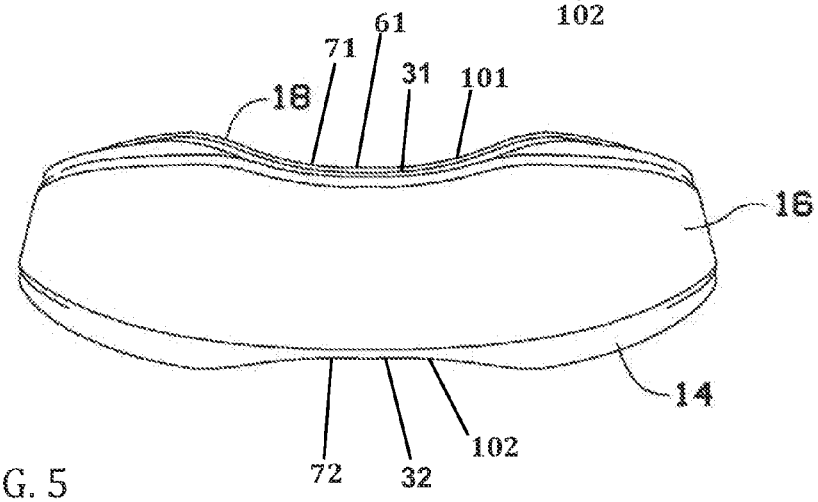
FIG. 5 shows a rear view of the present invention.
Figure 6:
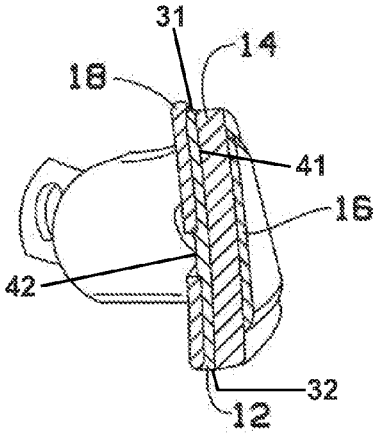
FIG. 6 shows a cross-sectional view of the present invention.
Figure 7:
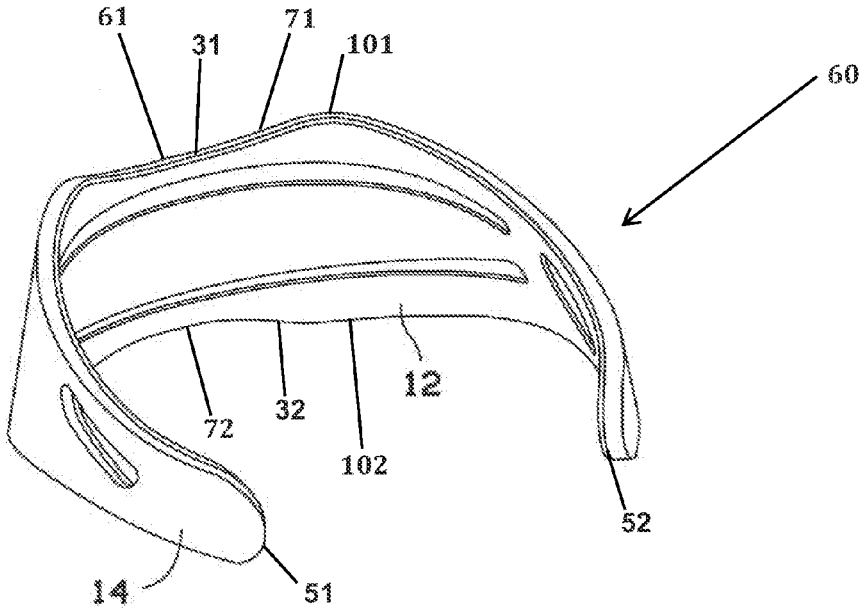
FIG. 7 shows a front perspective view of an alternative embodiment of the present invention.
Figure 8:
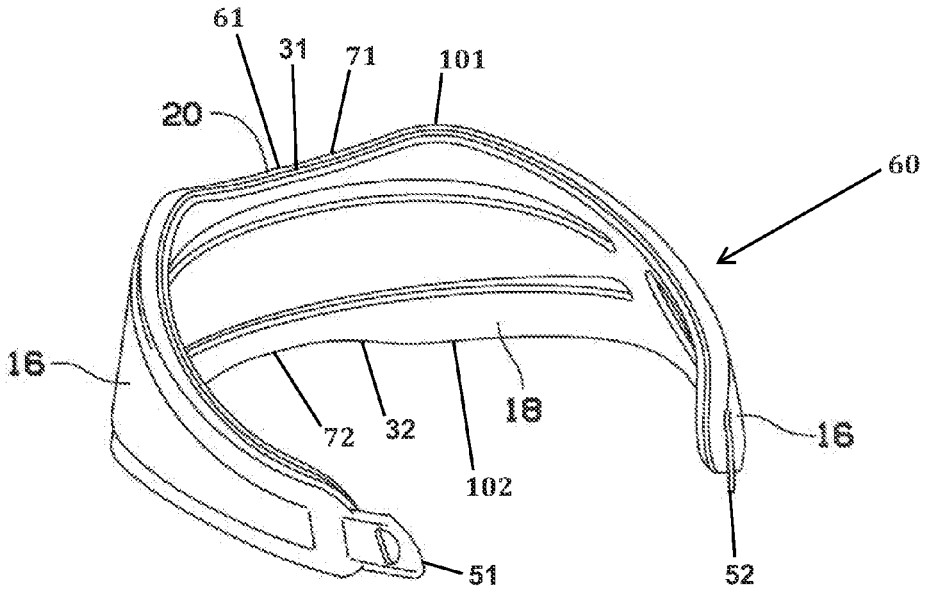
FIG. 8 shows a front perspective view of an alternative embodiment of the present invention.
Figure 9:
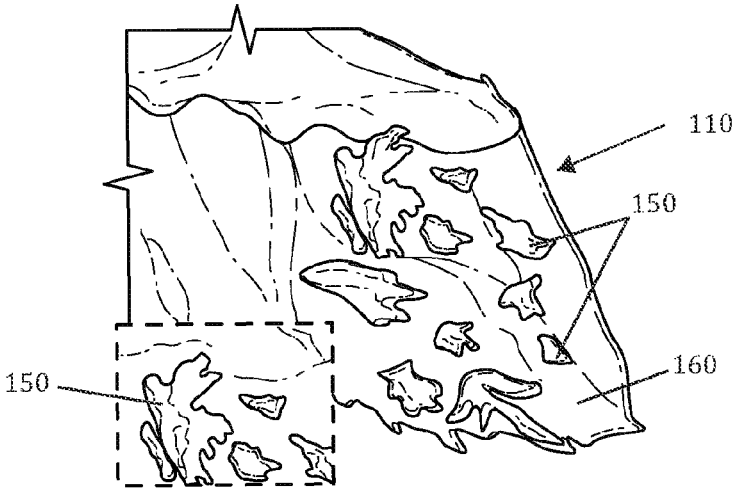
FIG. 9 shows a perspective view of the core material of the present invention.
Figure 10:
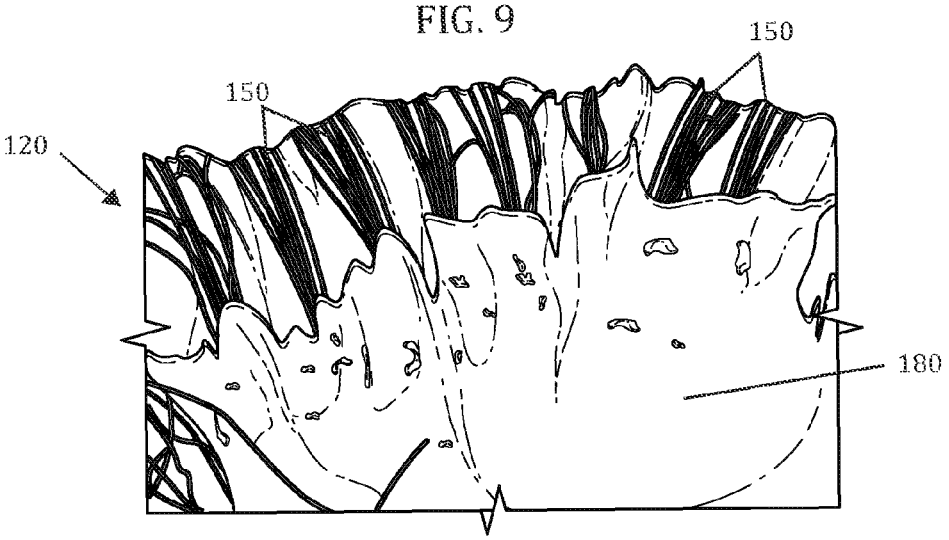
FIG. 10 shows a perspective view of the shell material of the present invention.
Figure 11:
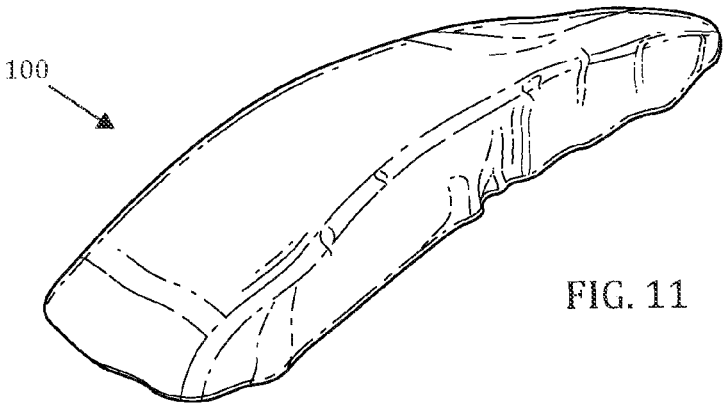
FIG. 11 shows a perspective view of the core material disposed inside a skin material.

The following is a list of elements corresponding to a particular element referred to herein:

12 shell frame
14 impact-absorbing layer
15 impact-absorbing layer external surface
16 tension and stabilizer strap
18 skin-side memory foam layer
24 adjustable strap
31 shell frame first edge
32 shell frame second edge
41 shell frame first side surface
42 shell frame second side surface

51 first terminating end
52 second terminating end
60 c-shaped structure
61 mid-region
71 first indentation
72 second indentation
100 synthetic neck muscle system
101 system first edge
102 system second edge
105 first height
106 second height
110 core material
120 shell material
150 fiber material
160 foam or gel
170 microsphere
180 putty material
190 skin Referring now to FIGS. 1-11, the present invention features a method of reducing impact forces and head and neck injuries. According to one embodiment, the method may comprise providing a synthetic neck muscle system (100) and wrapping the synthetic neck muscle system (100) around a user's neck.

In one embodiment, the system (100) may comprise a shell frame (12), an impact-absorbing layer (14), and a skin-side memory foam layer (18). The shell frame (12) may comprise a shell frame first edge (31), a shell frame second edge (32), a shell frame first side surface (41), and a shell frame second side surface (42). The shell frame may provide rigidity and shape to the system. The shell frame also acts as an attachment point for other layers that provide further protection and comfort to the user. The shell frame (12) may be formed in a C-shape. In one embodiment, the shell frame may have a shell material (120) embedded therein. In another embodiment, the shell material (120) may comprise a putty material (180) and a fiber material (150). In some embodiments, the fiber (150) reinforces the putty (180), providing the putty with physical properties useful for protecting the user (i.e. a balance of rigidity—which insures that the system (100) keeps its appropriate shape and does not permanently deform during use—and pliability—which insures that collisions with the system are increasingly inelastic, thereby decreasing kinetic energy imparted on the user).

In some embodiments, the impact-absorbing layer (14) may be disposed on the shell frame first side surface (41). The impact-absorbing layer (14) may have a core material (110) embedded therein. In one embodiment, the core material (110) may comprise a foam material (160) and the fiber material (150). In another embodiment, a plurality of microspheres (170) may be disposed within the foam material (160). The fiber (150) can reinforce the foam (160) to provide the foam with physical properties useful for protecting the user (i.e. a balance of rigidity—which insures that the system (100) has appropriate puncture-resistant properties—and pliability—which insures that collisions with the system are increasingly inelastic, thereby decreasing kinetic energy imparted on the user). The microspheres (170) further absorb and dissipate forces that act upon the user, thereby further protecting the user. Preferably, the impact-absorbing layer (14) is disposed continuously on the shell frame first side surface (41) from the shell frame first edge (31) to the shell frame second edge (32) such that the core material (110) is bonded to the shell material (120). This provides a broad surface of impact-absorbing layer (14) that covers the entirety of one surface of the system (100), thereby providing extra protection to a user of the method of the present invention.

The impact-absorbing layer (14) acts in conjunction with the shell frame (12) to further reduce impact forces and injuries to the head and neck of the user. The impact-absorbing layer (14) absorbs and dissipates forces that act upon the user, thereby protecting the user. For example, if, during athletic activity, the user is hit in the neck by a projectile (e.g. a tennis ball), the impact-absorbing layer (14) absorbs and dissipates the force that the tennis ball applies to the system (100), which would otherwise be applied directly to the neck of a user not practicing the method of the present invention. A user practicing the method of the present invention is thereby protected from this, similar impacts, and other similar forces.

In some embodiments, the skin-side memory foam layer (18) is disposed on the shell frame second side surface (42). The skin-side memory foam layer (18) can increase the user's comfort when using the system (100). Preferably, the skin-side memory foam layer (18) is disposed continuously on the shell frame second side surface (42) from the shell frame first edge (31) to the shell frame second edge (32). This provides a broad surface of skin-side memory foam layer (18), which, when the skin-side memory foam layer (18) comes into contact with the user during use of the system (100), increases the user's comfort. In other embodiments, the impact-absorbing layer (14) and the skin-side memory foam layer (18) are flushed with the shell frame first edge (31) to form a system first edge (101). In still other embodiments, the impact-absorbing layer (14) and the skin-side memory foam layer (18) are flushed with the shell frame second edge (32) to form a system second edge (102). These uniform edges provide added comfort a user by avoiding placement of sharp or otherwise uncomfortable edges on edges of the system (100) that may come into contact with the user while the system (100) is being worn.

Preferably, the system (100) is molded into a C-shaped structure (60) comprising a first terminating end (51), a second terminating end (52), a mid-region (61) disposed between the first terminating end (51) and the second terminating end (52). In one embodiment, a first indentation (71) may be disposed on the system first edge (101) at the mid-region (61). In another embodiment, a second indentation (72) may be disposed on the system second edge (102) at the mid-region (61). According to some embodiments, a first height (105) between the system first edge (101) and the system second edge (102) at the mid-region (61) is greater than a second height (106) between the system first edge (101) and the system second edge (102) at the first terminating end (51) or the second terminating end (52).

The first indentation (71) and the second indentation (72) combine to form a "peanut shape" of the system (100) to provide added comfort to a user. This shape maximizes the area protected on the user, while also allowing the user to move his or her head and neck freely without obstruction from the system (100).

In preferred embodiments, the synthetic neck muscle system (100) is wrapped around the user's neck such that the skin-side memory foam layer (18) interfaces with the user's neck and the impact-absorbing layer (14) faces away from the user's neck. For instance, the system first edge (101) is disposed proximal to the user's head and the system second edge (102) is distal to the user's head. Preferably, the mid-region (61) is disposed on a nape of the neck such that the first indentation (71) is directly proximal to an occiput of a user's head and the second indentation (72) is distal to the occiput. The first terminating end (51) may be disposed on a right lateral side of the user's neck and the second terminating end (52) may be disposed on a left lateral side of the user's neck such that a throat of the user is positioned between the first terminating end (51) and the second terminating end.

In some embodiments, when 100 newtons of compression force is applied to the neck wearing the system (100), the system (100) effectively reduces neck displacement by 30% to 50% as compared to a neck without the system (100). In other embodiments, when 100 newtons of linear sheer force is applied to the neck wearing the system (100), the system (100) effectively reduces neck displacement by 25% to 45%, as compared to a neck without the system (100). In still other embodiments, when 50 newton-meters of torsional sheer force is applied to the neck wearing the system (100), the system effectively reduces neck displacement by 10% to 30%, as compared to a neck without the system (100). In further embodiments, when an impact having a mass of 2.7 kg and velocity of 3.0 m/sec is applied to a neck wearing the system (100), the system (100) effectively reduces a measured peak force by 30% to 50% and effectively increases a duration of time to reach the peak force by 180% to 200%, as compared to a neck without the system (100).

According to one embodiment, the system (100) may further comprise a tension and stabilizer strap (16) disposed at least partially on an impact-absorbing layer external surface (15) of the impact-absorbing layer (14). The tension and stabilizer strap (16) provides a desirable level of tension to the system, which insures that the system remains on the user's neck. According to another embodiment, the system (100) may further comprise an adjustable strap (24) disposed on the first terminating end (51) or the second terminating end (52). The adjustable strap (24) may be adjusted to fit each individual user, and provides for secure attachment of the system (100) to the neck of the user. For instance, the method may further comprise connecting the first terminating end (51) and the second terminating end (52) by looping the adjustable strap (24) through an aperture of the terminating end opposite from the terminating end on which the adjustable strap is disposed such that the adjustable strap is positioned across the user's throat and aligned below an underside of a chin of the user.

In another embodiment, the present invention may feature a method of reducing impact forces and head and neck injuries. Said method may comprise providing a synthetic neck muscle system (100) and disposing the synthetic neck muscle system (100) on the user's neck.

In one embodiment, the system (100) may comprise a shell frame (12) formed in a C-shape and an impact-absorbing layer (14). The shell frame (12) may comprise a shell frame first edge (31), a shell frame second edge (32), a shell frame first side surface (41), and a shell frame second side surface (42). In another embodiment, the impact-absorbing layer (14) may be disposed on the shell frame first side surface (41). For instance, the impact-absorbing layer (14) may be disposed continuously on the shell frame first side surface (41) from the shell frame first edge (31) to the shell frame second edge (32). The impact-absorbing layer (14) may be flushed with the shell frame first edge (31) to form a system first edge (101), and flushed with the shell frame second edge (32) to form a system second edge (102);

In some embodiment, the shell frame (12) may have embedded therein a shell material (120) comprising a putty material (180) and a fiber material (150). In other embodiments, the impact-absorbing layer (14) may have a core material (110) embedded therein. For example, the core material (110) may comprise a foam material (160) and the fiber material (150). A plurality of microspheres (170) may be disposed within the foam material (160).

According to one embodiment, the system (100) is molded into a C-shaped structure (60). The C-shaped structure (60) may comprise a first terminating end (51), a second terminating end (52), a mid-region (61) disposed between the first terminating end (51) and the second terminating end (52). In some embodiments, a first indentation (71) may be disposed on the system first edge (101) at the mid-region (61). In other embodiment, a second indentation (72) may be disposed on the system second edge (102) at the mid-region (61). In still other embodiments, a first height (105) between the system first edge (101) and the system second edge (102) at the mid-region (61) is greater than a second height (106) between the system first edge (101) and the system second edge (102) at the first terminating end (51) or the second terminating end (52).

According to one embodiment, the system (100) may further comprise a skin-side memory foam layer (18) disposed on the shell frame second side surface (42). For instance, the skin-side memory foam layer (18) is disposed continuously on the shell frame second side surface (42) from the shell frame first edge (31) to the shell frame second edge (32) such that the skin-side memory foam layer (18) is flushed with the shell frame first edge (31) and the shell frame second edge (32).

In an exemplary embodiment, the system (100) is disposed on the user's neck such that the skin-side memory foam layer (18) interfaces with the user's neck and the impact-absorbing layer (14) faces away from the user's neck. The system first edge (101) may be disposed proximal to the user's head and the system second edge (102) may be distal to the user's head. The mid-region (61) may be disposed on a nape of the neck such that the first indentation (71) is directly proximal to an occiput of a user's head and the second indentation (72) is distal to the occiput. In another embodiment, the first terminating end (51) is disposed on a right lateral side of the user's neck and the second terminating end (52) is disposed on a left lateral side of the user's neck such that a throat of the user is positioned between the first terminating end (51) and the second terminating end (52).

In one embodiment, the system (100) may further comprise a tension and stabilizer strap (16) disposed at least partially on an impact-absorbing layer external surface (15) of the impact-absorbing layer (14).

In another embodiment, the system (100) may further comprise an adjustable strap (24) disposed on the first terminating end (51) or the second terminating end (52). For example, the method may further comprise connecting the first terminating end (51) and the second terminating end (52) by looping the adjustable strap (24) through an aperture of the terminating end opposite from the terminating end on which the adjustable strap is disposed such that the adjustable strap is positioned across a throat of the user and aligned below an underside of a chin of the user.

In further embodiments, the present invention may feature a method of reducing impact forces and head and neck injuries by providing a synthetic neck muscle system (100) and disposing the synthetic neck muscle system (100) on the user's neck. In some embodiments, the system (100) may comprise a shell frame (12) and an impact-absorbing layer (14). According to one embodiment, the shell frame (12) may comprise a shell frame first edge (31), a shell frame second edge (32), a shell frame first side surface (41), and a shell frame second side surface (42). Preferably, the shell frame (12) is formed in a C-shape. The shell frame may have a shell material (120) embedded therein. For example, the shell material (120) may comprise a putty material (180) and a fiber material (150).

In one embodiment, the impact-absorbing layer (14) is disposed continuously on the shell frame first side surface (41) from the shell frame first edge (31) to the shell frame second edge (32) such that the core material (110) is bonded to the shell material (120). The impact-absorbing layer (14) may be flushed with the shell frame first edge (31) to form a system first edge (101), and the impact-absorbing layer (14) may be flushed with the shell frame second edge (32) to form a system second edge (102). In another embodiment, the impact-absorbing layer (14) may have a core material (110) embedded therein. The core material (110) may comprise a foam material (160) and the fiber material (150). In some embodiments, a plurality of microspheres (170) may be disposed within the foam material (160).

According to a preferred embodiment, the system (100) is molded into a C-shaped structure (60) comprising a first terminating end (51), a second terminating end (52), a mid-region (61) disposed between the first terminating end (51) and the second terminating end (52), a first indentation (71) disposed on the system first edge (101) at the mid-region (61), and a second indentation (72) disposed on the system second edge (102) at the mid-region (61). In another preferred embodiment, a first height (105) between the system first edge (101) and the system second edge (102) at the mid-region (61) is greater than a second height (106) between the system first edge (101) and the system second edge (102) at the first terminating end (51) or the second terminating end (52).

In one embodiment, the system (100) may further comprise a skin-side memory foam layer (18) disposed on the shell frame second side surface (42). Preferably, the skin-side memory foam layer (18) is disposed continuously on the shell frame second side surface (42) from the shell frame first edge (31) to the shell frame second edge (32). For instance, the skin-side memory foam layer (18) may be flushed with the shell frame first edge (31) and the shell frame second edge (32).

In some embodiments, the system (100) is disposed on the user's neck such that the skin-side memory foam layer (18) interfaces with the user's neck and the impact-absorbing layer (14) faces away from the user's neck. The system first edge (101) may be disposed proximal to the user's head and the system second edge (102) may be distal to the user's head. In one embodiment, the mid-region (61) may be disposed on a nape of the neck such that the first indentation (71) is directly proximal to an occiput of a user's head and the second indentation (72) is distal to the occiput. In another embodiment, the first terminating end (51) is disposed on a right lateral side of the user's neck and the second terminating end (52) is disposed on a left lateral side of the user's neck such that a throat of the user is positioned between the first terminating end (51) and the second terminating end (52).

According to one embodiment, the system (100) may further comprise a tension and stabilizer strap (16) disposed at least partially on an impact-absorbing layer external surface (15) of the impact-absorbing layer (14). According to another embodiment, the system (100) may further comprise an adjustable strap (24) disposed on the first terminating end (51) or the second terminating end (52). The method may comprise connecting the first terminating end (51) and the second terminating end (52) by looping the adjustable strap (24) through an aperture of the terminating end opposite from the terminating end on which the adjustable strap is disposed such that the adjustable strap is positioned across a throat of the user and aligned below an underside of a chin of the user.

The combination of a system (100) comprising both a shell frame (12) further comprising a shell material (120) and an impact-absorbing layer (14) further comprising a core material (110) provides a synergistic protective effect to the user of the system (100) by providing the benefits of the shell material (120) (e.g. an appropriate protective C-shape and impact-absorption) and the core material (110) (e.g. impact absorption and puncture-resistance) in a single embodiment of the system (100) of the present invention. In some embodiments, the system (100) of further comprises a skin-side memory foam layer (18), increasing the user's comfort.

TABLE 1

| | Without Device | Displacement With Device | Reduction in Displacement |
|---|---|---|---|
| Compression (100 N load) | 2.0 mm | 1.2 mm | 40% |
| Linear Sheer (100 N Load) | 2.7 mm | 1.8 mm | 33% |
| Torsional Sheer (50 N-m torque) | 18 deg | 14 deg | 22% |

Table 1 shows the neck displacement advantage of system (100). The testing used an MTS Bionix Spine Kinematics System with a system (100) wrapped around a rubber mandrel to simulate the human neck. When a 100 N compression load was applied to the mandrel, the displacement of the mandrel by 40%, compared to the same mandrel without the system (100). A 33% reduction in linear displacement of the mandrel was observed when a 100 N linear sheer load was applied to the mandrel with the system (100) compared to the same mandrel without the system (100). The reduction in rotation of the mandrel was 22% when a 50 N torsional sheer load was applied with and without the system (100).

TABLE 2

| | Baseline Material | Peak Force With Synthetic Muscle | Reduction in Measured Force |
|---|---|---|---|
| Measured Peak Force (N) | 880 | 520 | 40% |
| Time to Maximum Force (msec) | 11 | 21 | |

Table 2 shows the impact force reduction advantage of a system (100). A base material, used to simulate the skin, was impacted with a mass of 2.77 kg at a velocity of 3.0 m/sec. The peak force measured in the base material was 880 N. When the system (100) was placed on the surface of the base material, the measured peak force was reduced by 40%.

In some embodiments, the method of the present invention reduces the neck displacement of a human wearing the system (100) by 30% to 50% when acted upon by 100 newtons of compression force applied to the neck, as compared to a human that is not wearing the system (100). In some embodiments, said neck displacement is reduced by 35% to 45%. In some embodiments, said neck displacement is reduced by 37.5% to 42.5%.

In some embodiments, the method of the present invention reduces the neck displacement of a human wearing the system (100) by 25% to 45% when acted upon by 100 newtons of linear sheer force applied to the neck, as compared to a human that is not wearing the system (100). In some embodiments, said neck displacement is reduced by 30% to 40%. In some embodiments, said neck displacement is reduced by 35% to 40%.

In some embodiments, the method of the present invention reduces the neck displacement of a human wearing the system (100) by 10% to 30% when acted upon by 50 newton-meters of torsional sheer force applied to the neck, as compared to a human that is not wearing the system (100). In some embodiments, said neck displacement is reduced by 15% to 25%. In some embodiments, said neck displacement is reduced by 17.5% to 20%.

In some embodiments, the system (100) is effective to reduce a measured peak force applied to the user's neck by 30% to 50%, as caused by an impact of a mass of 2.77 kg at a velocity of 3.0 m/sec, as compared to a human not using the system (100). In some embodiments, the system (100) is effective to reduce said measured peak force by 35% to 45%. In some embodiments, the system (100) is effective to reduce said measured peak force by 37.5% to 40%.

In some embodiments, the system (100) is effective to increase a time to maximum force applied to the user's neck by 180% to 200%, as caused by an impact of a mass of 2.77 kg at a velocity of 3.0 m/sec, as compared to a human not using the system (100). In some embodiments, the system (100) is effective to increase said time to maximum force by 185% to 195%. In some embodiments, the system (100) is effective to increase said time to maximum force by 187.5% to 190%.

In further embodiments, the present invention features a synthetic neck muscle system (100) for use in personal protective equipment for minimizing a risk of an injury, when worn by a user. In some embodiments, the system (100) comprises a core material (110). In some embodiments, the core material (110) comprises a foam (160) and a fiber (150). In some embodiments, the core material (110) comprises a fiber (150)—reinforced gel. In some embodiments, anywhere foam (160) is cited, gel can be used. In some embodiments, a plurality of microspheres (170) is located therein.

In some embodiments, the system (100) comprises a shell material (120) encapsulating and bonded to the core material (110). In some embodiments, the shell material (120) comprises a putty (180) and a fiber (150).

In some embodiments, the system (100) is molded into a form. In some embodiments, the form resembles a shape of a human muscle.

In some embodiments, the core material (110) is fiber (150)—reinforced polyurethane foam (160). In some embodiments, the core material (110) is fiber (150)—reinforced urethane foam (160).

In some embodiments, the core material (110) is directional fiber (150) and foam (160). In some embodiments, the directional fiber (150) is longitudinal and in-line with respect to the core material (110). In some embodiments, the directional fiber (150) is perpendicular with respect to the core material (110).

In some embodiments, the microspheres (170) are hollow glass microspheres (170). In some embodiments, the microspheres (170) are hollow plastic microspheres (170).

In some embodiments, the shell material (120) is dilatant fiber (150) and putty (180). In some embodiments, dilatant means increasing in viscosity and setting to a solid as a result of deformation by expansion, pressure, or agitation (http://www.merriam-webster.com/dictionary/dilatant).

In some embodiments, the shell material (120) is directional fiber (150) and putty (180). In some embodiments, the directional fiber (150) is longitudinal and in line with respect to the putty (180). In some embodiments, the directional fiber (150) is perpendicular with respect to the putty (180).

In some embodiments, the shell material (120) is transparent. In some embodiments, the shell material (120) is translucent. In some embodiments, the shell material (120) is opaque. In some embodiments, the core material (110) is transparent. In some embodiments, the core material (110) is translucent. In some embodiments, the core material (110) is opaque. In some embodiments, the system (100) is transparent. In some embodiments, the system (100) is translucent. In some embodiments, the system (100) is opaque.

In some embodiments, the shell material (120) is entirely encapsulated by an outer skin (190). In some embodiments, the outer skin (190) is a membrane. In some embodiments, the outer skin (190) is entirely sealed. In some embodiments, the outer skin (190) entirely seals the system (100) from an ambient environment. In some embodiments, the outer skin (190) is pliable and flexible.

In some embodiments, the system (100) is remoldable into a new form.

In some embodiments, the system (100) is spun into a fiber (150) or a thread. In some embodiments, the system (100) is formed into a cord. In some embodiments, the system (100) is formed into a sheet. In some embodiments, the system (100) can be rolled onto a spool. In some embodiments, the system (100) is formed into intertwining layers or braided like a cord. In some embodiments, the system (100) can be woven into a cloth material.

In some embodiments, a sensor is located therein. In some embodiments, the sensor detects a physiological function of a human, for example, temperature, pulse, blood pressure, gravitational force (g-force) encountered, etc. In some embodiments, the sensor is operatively connected to a power supply. In some embodiments, the sensor is operatively connected to a microprocessor. In some embodiments, the sensor is operatively connected to a transmitter. In some embodiments, the sensor is operatively connected to a receiver.

In some embodiments, the system (100) is bonded to a foam (160) layer. In some embodiments, the foam (160) layer is memory foam.

In some embodiments, a vibration component operatively connected to a power supply is located therein. In some embodiments, the vibration component provides a massaging function to the system (100). In some embodiments, a heating component operatively connected to a power supply is located therein.

In some embodiments, the system (100) is integrated into a personal protective equipment device. In some embodiments, the personal protective equipment device is a neck brace, a knee brace, a back brace, a joint brace, a helmet, a pad, a shield, a wrap, a mouth guard and the like.

In some embodiments, the system (100) features a highly dilatant fiber reinforced putty shell in combination with a directional fiber reinforced polyurethane (body) molded in a muscle replicated geometric configuration formation. In some embodiments, the system (100) features a protective bio-mimetic synthetic muscle shell material embodiment. In some embodiments, mixtures range from 2.2 to 1, 3 to 1, 9 to 1, and 12 to 1, depending on the device objective and geometric shape, size, force or impact situations. For example, a helmet, an athletic cup, a neck protector, a hip, chest, thigh, or shoulder protector. In some embodiments, the system (100) includes a highly dilatant fiber-reinforced putty shell, a directional fiber reinforced polyurethane, a thixotropic fiber-threaded (reinforced) polyurethane, and a dilatant fiber-threaded (reinforced) putty. In some embodiments, the system (100) is bonded at the molding process with a base molded body and a bonded shell (laminated, vulcanized) layer. In some embodiments, the system offers protection aspects like aluminum and semi-hard to hard plastics at impact and stress and or loads. When relaxed, the system (100) is soft, light, and almost invisible. In some embodiments, the system (100) offers human flesh-like aspects.

In some embodiments, the synthetic neck muscle system (100) is a custom mixture of materials, blended, mixed, molded, cured, bound and compressed. In some embodiments, the system (100) comprises a set of polyurethanes, proprietary chemicals, micro-glass fiber spheres, and fiber threads. In some embodiments, the system (100) comprises materials geometrically architected and modeled together in a fashion to replicate, mimic, enhance and support muscle protection functions and operation reaction (high speed proactive) enforcement protective characteristics upon impacts, loads, and bearings of the muscle structure itself. In some embodiments, the material as engineered will be a shared utility technology to be used for next generation helmets, shoulder, elbow, shin, knee and hip pads, mouth guards, athletic supporters, and the like moving forward.

In some embodiments, as a simplified example, a well-known putty (180) is Silly Putty®. This putty (180) is soft and flexible, but at high speed impact, load or beaning (throwing it against the wall) it becomes instantly hard to repel, dissipate and protect the mass itself. Upon retrieval, it is shown to remain in a soft putty-like form.

This system (100) is correctly blended, mixed, molded and assembled into human muscular protection configurations. The system (100) allows the potential of increasing human survivability rate exponentially in human physical activity of human structure breach or overload. The system (100) will from a pre-injury view react with muscle structure, contractions, extensions, rotations, compressions as well as blunt form trauma object impacts and proactivity deliver the necessary added reactions and support to prevent the injury resultant impact or load point. In some embodiments, the system (100) replicates and spreads energy over the widest area of muscle flesh and bone to provide the greatest sustainability and survivability injury results. The incoming forces are defused, de-focused and redirected. Instead of making the area harder, the system (100) makes the area softer.

In some embodiments, there are advantages with the system (100). The synthetic neck muscle system (100) is a designed layer in the device material stack and is already semi-prototyped with older obsolete protection gel-like materials. It is molded and compressed and formed into the device assembly layers, similar to the layers of material in a tennis shoe or bullet-proof vest and shoe sole support insert. It has an estimated 15% to 25% reduced weight. It is able to be used in a subtle manner sometimes undetected under a uniform. It increases overall protection results by an estimated 25% to 40%. It allows next generation adaptability to the neck element of the solution. Next generation helmets, as well as shoulder, knee, shin, and elbow pads will have similar material advances all working in harmony as a human mechanisms protection solution. The system (100) facilitates using production tooling across the industry. As an example, one synthetic model shell can be used for multiple audiences or customers. For example, players of football, hockey, soccer, etc. can use the same shell mold with slightly different wrappings or packaging for the specific audience or sport. The remote vital sensor design, production and resource requirements will be simplified. The synthetic muscle amplifies the neck device and supportive enhancements of force and load bearings this retuning of the human mechanical system to improve its structural properties in a load, impact, stress or impact injury scenario.

The device is made with a smart synthetic flexible material, specially shaped to fit around the neck and provides the needed protection to the human muscle structure as a moving element of multiple moving parts of the muscle structure itself, the head on the neck attached to the shoulders for example, or the gimbal neck spine area called the axis and the atlas. In an interactive proactive manor, when someone flexes their arm, their bicep becomes stronger. In injury situations the current human structure is pushed beyond its means, thus the need for sports protective equipment in the first place. The protection has to be faster than the current over-pushed human muscle and bone structure as it is today. Regarding, the need for protective gear, the system is advancing the success rate of protection gear, making it faster, softer, smarter, intelligent, integrated and lighter. A 1952 current sports protection solutions base to a 22nd century and beyond technology solution base is the end result. When a user encounters contact that may cause a concussion (TBI) or spinal cord (SCI) injury the neck device and intelligent synthetic smart muscle will deliver a proactive level of protection that performs the same as flexed muscle. This action will minimize the forces and velocity of contact and the injury is avoided or reduced in severity up to possibly 70%. This works like a tennis shoe, it lessens the force and loads of bending, wiping and twisting to avoid reaching the point of causing a severe TBI or SCI injury.

Existing design with material enhancements can be easily implemented and updated over time with the same outer shell but revised inner snap-in synthetic muscle shell insert.

In some embodiments, the system (100) can be extruded. In some embodiments, the system (100) can be extruded as a thread. In some embodiments, the system (100) can be used to construct a garment.

Unique features of the present invention include the curvature of the synthetic muscles shell, synthetic muscles, and remote vital monitoring. Synthetic muscles shell, is the replication of each muscle and using the Synthetic Muscles materials as the substance to replicate a muscle to enhance, monitored and or protect. The Shell is what is called geometrical (3D CAD) muscles replication of each muscle to be protected, skull or head, neck or shoulders, chest and back, hips and shins, etc. For the shell mesh the Synthetic Muscles will be shaped in a shell, geometrical shape. The shell curative is specific to the device as the muscle to replicate has specific curves (bio-quartic splines). The shell only applies to the neck, for example there will be Synthetic Muscles curvature/shell for the helmet, but Synthetic Muscle mesh dome like-curves to define the head and helmet. With respects to curvature or what is called a shell, the curvature is unique, meaning, the helmet will have a different curvature shape will also have a different curvature shoulder pads and chest will have specific curvatures those are created with the use of synthetic muscle. The curvature uniqueness is dependent on the muscle or the part of the body that needs to be protected. For example the neck will have a different curvature which is called a bio-quadratic surface just like a turbine blade. The head will have like a shell but will also be bio-quadratic. For example, it will always have edges defined by three-dimensional polynomial curves. Each different part of the body that uses a synthetic muscle will have definitions of muscles defined with these type of curves. It is a uniqueness with the application of synthetic muscle to the next device. It is what is typically called an undevelopable surface—the same type the surface as a turbine blade or a fan blade. The shape, no matter what part of the cross-section, has a directional force attribute. The neck on every human the curves around the bottoms and tops producing an undevelopable surface. It is actually developable but a person has to know how to do it. There is a well-known medical term called the trapezoidal mechanism from the skull and neck with surfaces that mimic that natural muscle shape.

In some embodiments, the system is molded and architected for a specific body part of protection and enhancements. In some cases a person will be able to perform better, stronger, longer, with the system wrapped around their body.

The system will also be available for garments in fabric weaving industries. A single muscle fiber this is very small in diameter and will be spooled up on a fiber to be placed into garment sewing machines.

If a helmet, for example, is made out of the material, the system will increase survivability and sustainability of velocities to the skull with exponential results.

The material will be soft at its relaxed state. It will off to an semi-transparent to the individual wearing it. And with normal impact and force, it will be soft but hard at impact to exceed the impact force itself.

The soft-like material will get instantly hard at impact and do so to the point of getting harder faster than the impact itself, thus dissipating forces to velocities and overall force in sheer protection is achieved. The faster the velocity of impact the higher the velocity of material reaction is achieved. The material when normally use is exceeded by high velocity impacts, the material will get harder faster than the impact itself thus protecting the embodiment.

The material will be soft, flexible, and semi-transparent at normal use.

The system will allow today's current protection solution manufacturers to utilize system for them to achieve and design a much lighter faster quicker and safer type of protection solution.

The device will dissipate absorb deflect and channel all impact forces from velocities. A quick twist or a compress blunt-force collision with the boards for example. This could be a high-speed torque a high-impact to a board for example this could be a blunt instrument as well anything that produces velocities the material will protect them from.

For example the material incorporated into a net device will amplify the protection and return exponential protection increase that the overall product desires.

For example with the material in a helmet, a person could basically take a baseball bat and swing at helmet without hurting the person. The material for the helmet will be micro thin three-way mashed fiber reinforced with velocity deflection control. The material will be able to mimic muscles meaning each muscle has a different function of flexing and protecting the system replicates that for each muscle of focus.

The material will be formulated and applied to industries such as sports, entertainment, firefighters and medical, therapeutic recoveries, and high-end security. The system can be used for remotely monitoring vitals as well as statistical analysis on sports and recreation on any part of the body that needs to have the next generation of protection included with today's digital frontier.

The focus of what the system replaces is the outdated plastic used on protective equipment. Plastic shells have cushioning materials that are well out of date as well. The system will be formulated to replace those same two elements of protection today—the outer plastic shell and the interim tampering foam. It will meet and exceed the same performance as today's equipment. $1/10^{th}$ the thickness with significant weight reduction and almost transparent, but performing many times better.

The device, the "sneaker" for the neck, is a device that goes around the neck with the high side in the back. The device absorbs (attenuates) the energy generated when force/load/strain/impact is a received at the top/bottom/side/front or back of the head, or the POI, point of impact (skull). The body becomes the pressure of the hammer and creates an unsupported upside down triangle with the body as pressures mass, down an funneled into the slinky or neck linkage, violent explosions of a flexed muscle mass, chemical reactions with HSV high speed velocity acceleration and deceleration on a free floating pressurized neck or slinky. The adjacent weaker body, the skull is violently wiped and slammed and the acc/dcc is dampered so the violent motion paths are minimized, such as when a hockey player goes head first (neck down) into the boards or a football player tackles with his head leading the attack. This force, if not attenuated, would otherwise cause axial compression of the cervical vertebrae. This axial compression could cause a fracture of the cervical vertebrae, usually C4 and/or C5. These fractured bones serve as a knife to cut the spinal cord at the C4 and/or C5 level, resulting in quadriplegia. In addition, this device attenuates blows to the head (from any angle) which could result in a concussive injury to the brain.

Kids nowadays feel like they are not injury prone nor do they think that they can hurt anyone, they are bigger, faster, stronger now at younger ages than ever before, more so at the younger levels. To achieve the competitive edge they need to train harder and smarter and have healthy diets. The increase and difference even at the squirt, peewee, bantam and high school levels are staggering. There will be more neck injuries at all ages in the future, there is no way around it but the system will help save some of them today and more of them over time. This is done from a physical, mental and behavior standpoint that helps users all think & play safe.

A very important market and engineering vision comparison is, think about a shoe, a boot, a slipper, a sandal, a heavy boot or a dress shoe or skate, each one has a different objective or embodiment of the foot. The same concept "embodiment" has been designed for the neck and spine. Each shoe or boot has a different objective or embodiment of the same human structure, the foot. Each embodiment composition for the neck, just like the foot, but in this case the neck and spine has its utility composition embodiment's.

The present invention relates to survivability, sustainability and safety unit worn in high contact and heavy neck and spine load activities that can minimize injuries and increase survivability and sustainability. Conventional devices on the market at this time are not support devices and are not engineered to replicate and enhance muscle and bone kinematics skeleton characteristics. These conventional devices do NOT have compression resistance and DO restrict movement. It is apparent that there is a need for an improved safety unit that can be more effective in reducing the risk of injury and increase the probability of surviving an injury.

This safety device was designed to bring to market a thin support garment that focuses on critical zones of the vertebrae, C1-C7. Actions of 1-3 mm of violent (flex & extended flexation) movement, loads and impacts to these vertebrae can cause paralysis, brain trauma and even death. The safety device is light weight, intelligent micro-thin support and it does not restrict movement. It is the first safety device that is designed for the athlete to wear when involved in high impact sports such as hockey. It is an anti-concussion compression, survivability and sustainability safety device for the neck and spine. Scientifically engineered and designed by using computer technologies and geometric interacting shapes. This design simulates the head, neck muscles and skeleton frame movements and supportive behaviors.

Concussions (TBI) and spinal cord injuries (SCI) are on an alarming increase in many sports as well various hazardous environments, transportation, defense and other high speed activities. The neck has been overlooked for years and this high tech solution changes the survivability rates. The device changes and re-tunes the human mechanical system to improve its structural properties in a stress or impact injury scenario. This device is a very thin special shaped flexible material that wraps around the neck producing additional support against concussions and spinal cord injuries.

Modeled after the genetic variations in mammals that survive greater stresses and impacts than humans. The device re-tunes mass radius and moments of inertia towards that of a battle surviving mammal. A smart synthetic muscle, shoe for the neck and spine and the skull that is on the multi gimbal spine. It is a special shaped (patent) flexible material assembled and wrapped around the neck and produces added support to the neck.

When a user encounters a motion based concussion or spinal cord neck injury situation. The neck device will deliver a proactive level of injury protection support acting as a synthetic intelligent muscle reducing forces, velocity's and motions that cause a concussion or spinal cord injury by up to 70%. This injury is avoided and or reduced in severity to a survivability state. Similar to how a tennis shoe protects the toes from breakage and damage when under strain and loads, its ready when the body needs it. The proactive skull, neck and spine muscle solution like a rhino or a mountain goat.

The option for all models is the same product with added remote monitoring and medical capabilities. There will be built-in sensors, automatic generation of power, injection reservoirs, fire extinguisher, flotation device, and a complete programmable solution to be monitored remotely on a laptop or tablet or smart phone. A person will be able to monitor and control G-forces, impact pressures, acceleration, deceleration, speed and many other vital information. This will have a built in fetal Doppler component that will sense the babies vitals and monitor and record them as well. A light on the back of the unit will be automatically triggered at a G force limit. As well identify players in the out to hurt emotional state. Historic data will be accumulated over time.

Figure 12:
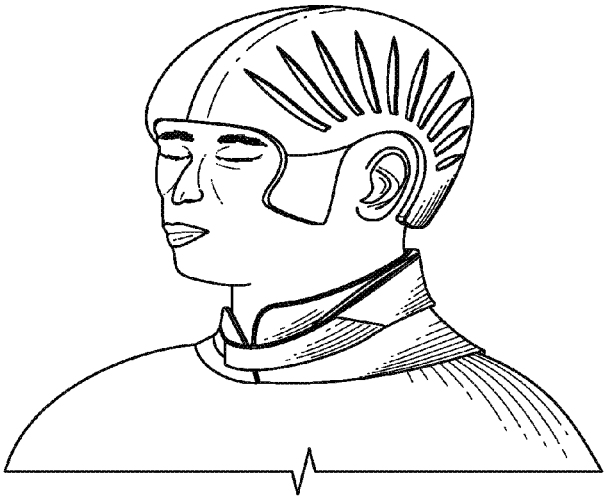
FIG. 12 shows a perspective view of an alternative embodiment of the present invention being worn with a micro-thin flexible helmet.
Figure 13:
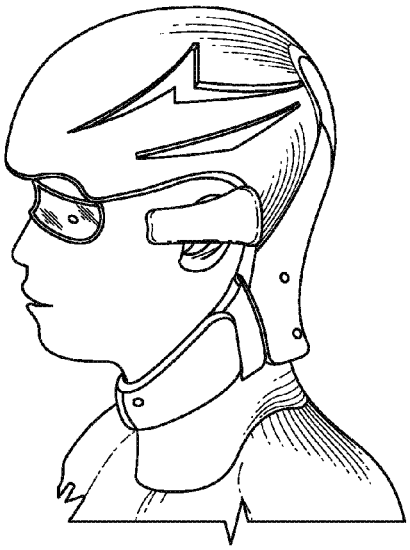
FIG. 13 shows a perspective view of an alternative embodiment of the present invention that is interconnected with a helmet.
Figure 14:
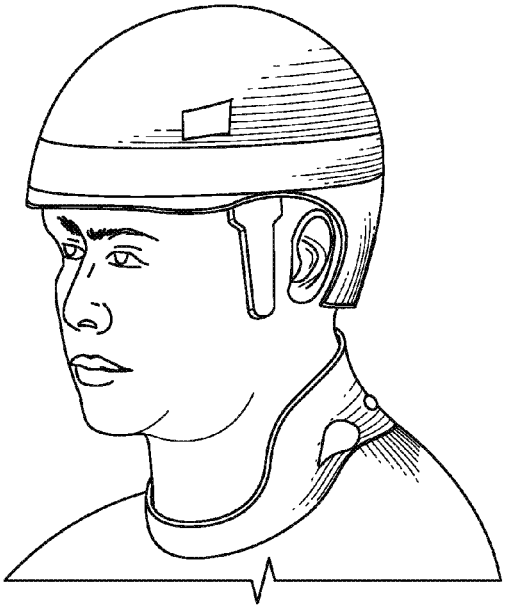
FIG. 14 shows a perspective view of an alternative embodiment of the present invention being worn with a micro-thin flexible helmet.

Referring now to FIGS. 12-20, alternative embodiments of the present inventions are described herein. For instance, FIGS. 12 and 14 show perspective views of alternative embodiments of the present invention that are being worn with micro-thin, flexible helmets. The helmets are not connected to the alternative embodiments of the systems of the method of the present invention. The helmet is preferably made out of the materials that comprise the system of the method of the present invention. Said materials give the helmet lightweight, cloth-like qualities while still providing superior levels of protection to the head of the user.

FIG. 13 shows a perspective view of an alternative embodiment of the present invention with a helmet. In this embodiment, the system is interconnected to the helmet. The helmet is preferably made out of the materials that comprise the system of the method of the present invention. The interconnect between the helmet and the system provides enhanced impact resistance and dissipation, as impacts to the head and/or neck are dissipated through both the neck-portion and the helmet-portion.

Figure 15:
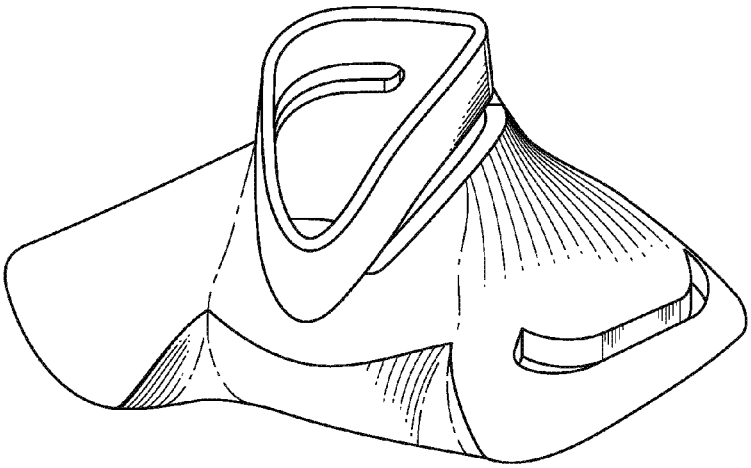
FIG. 15 shows a perspective view of a synthetic neck muscle system which incorporates shoulder pads, wherein said system preferably utilizes materials of the present invention.
Figure 16:
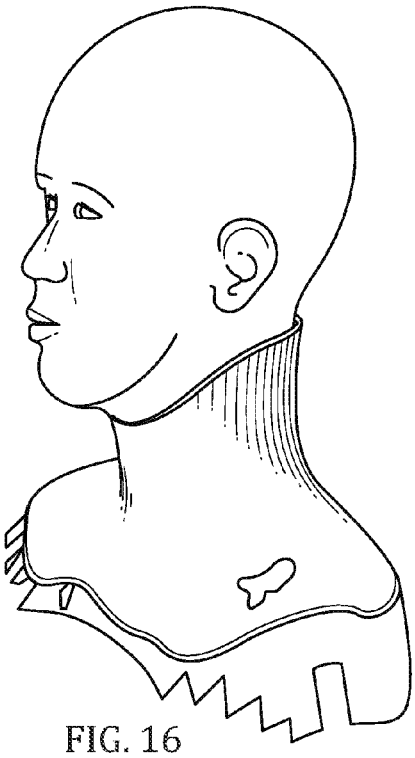
FIG. 16 shows a perspective view of a synthetic neck muscle system which incorporates shoulder pads, wherein said system preferably utilizes materials of the present invention.

FIGS. 15 and 16 show perspective views of a synthetic neck muscle system which incorporates shoulder pads, wherein said system preferably utilizes materials of the present invention. These systems provide enhanced protection to not only the shoulders and upper chest of the user, but also to the neck of the user, as any impact to the neck would be further dissipated over a larger surface area.

Figure 17:
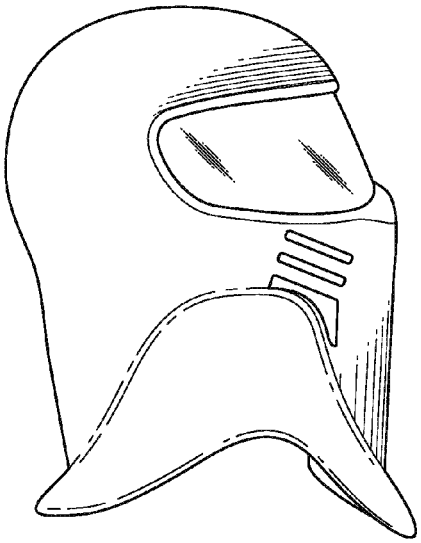
FIG. 17 shows a side view of synthetic neck muscle system which incorporates shoulder pads and an interconnected helmet, wherein said system preferably utilizes materials of the present invention.

FIG. 17 shows a side view of synthetic neck muscle system which incorporates shoulder pads and an interconnected helmet, wherein said system preferably utilizes materials of the present invention. Said system provides for even further neck and head protection from impacts to the head or neck of the user from any angle.

Figure 18:
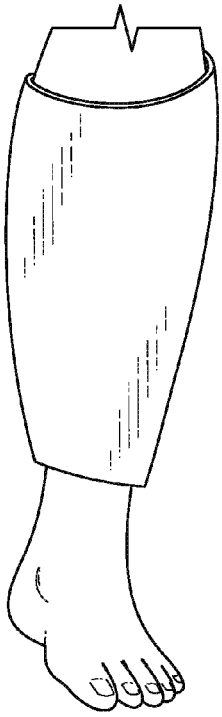
FIG. 18 shows a shin guard preferably incorporating materials used in the present invention.

FIG. 18 shows a shin guard system preferably incorporating materials used in the present invention. Said materials allow said system to be as thin as an average sock, yet still provide protection against bone breakage, lacerations, and other injuries. An appropriate size and fit for said system is preferably obtained through 3-D scan data and bio quadratic muscle replication 3-D surface to geometry processes.

Figure 19:
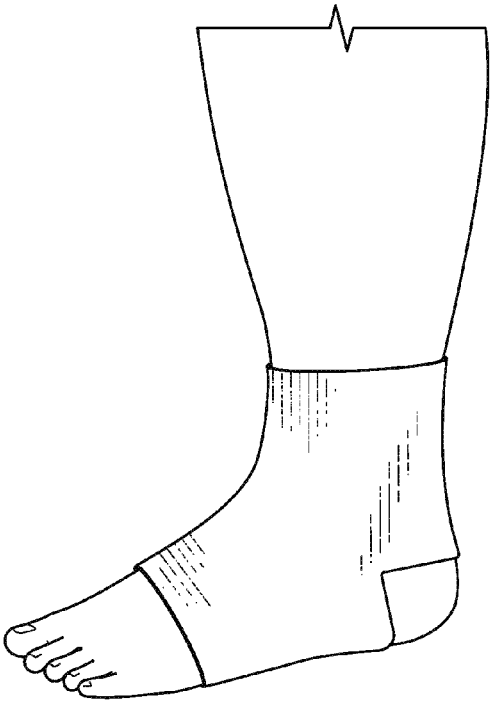
FIG. 19 shows an ankle guard preferably incorporating materials used in the present invention.

FIG. 19 shows an ankle guard system preferably incorporating materials used in the present invention. Said materials allow said system to be as thin as an average sock, yet still provide protection against bone breakage, lacerations, and other injuries. An appropriate size and fit for said system is preferably obtained through 3-D scan data and bio quadratic muscle replication 3-D surface to geometry processes.

Figure 20:
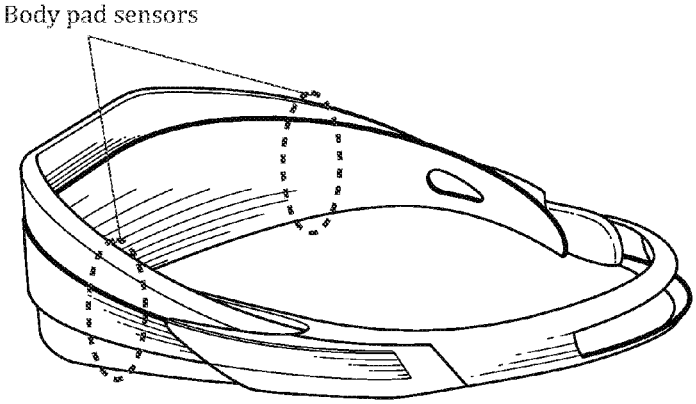
FIG. 20 shows a front perspective view of an alternative embodiment the present invention which incorporates body pad sensors to detect physiological and other signals. In one embodiment, the body pad sensors may detect F-force, body heat and perspiration, or heart rate.

FIG. 20 shows a rear perspective view of an alternative embodiment of the present invention which incorporates body pad sensors to detect physiological and other signals. Said sensors allow for real-time monitoring of impact forces to the head and neck, as well as sensing of other vital biometric information. Said information can be monitored while a user of the system is engaged in physical activity (e.g. playing sports). Said sensors preferably communicate via a Wi-Fi or other wireless connection to a computer, tablet, or other smart device. Parameters sensed by said sensors may include, but are not limited to, impact pressures, acceleration, heart rate, blood pressure, etc. Said data may be used to detect and prevent injury.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising"

includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A method of reducing impact forces and head and neck injuries, the method comprising:

a. providing a synthetic neck muscle system (100), the system (100) comprising:

i. a shell frame (12) comprising a shell frame first edge (31), a shell frame second edge (32), a shell frame first side surface (41), and a shell frame second side surface (42), wherein the shell frame (12) is formed in a C-shape, wherein the shell frame has a shell material (120) embedded therein, wherein the shell material (120) comprises a putty material (180) and a fiber material (150);

ii. an impact-absorbing layer (14), wherein the impact-absorbing layer (14) is disposed on the shell frame first side surface (41), the impact-absorbing layer (14) having a core material (110) embedded therein, wherein the core material (110) comprises a foam material (160) and the fiber material (150), wherein a plurality of microspheres (170) are disposed within the foam material (160), wherein the impact-absorbing layer (14) is disposed continuously on the shell frame first side surface (41) from the shell frame first edge (31) to the shell frame second edge (32) such that the core material (110) is bonded to the shell material (120); and iii. a skin-side memory foam layer (18), wherein the skin-side memory foam layer (18) is disposed on the shell frame second side surface (42), wherein the skin-side memory foam layer (18) is disposed continuously on the shell frame second side surface (42) from the shell frame first edge (31) to the shell frame second edge (32);

wherein the impact-absorbing layer (14) and the skin-side memory foam layer (18) are flushed with the shell frame first edge (31) to form a system first edge (101), wherein the impact-absorbing layer (14) and the skin-side memory foam layer (18) are flushed with the shell frame second edge (32) to form a system second edge (102), wherein the system (100) is molded into a C-shaped structure (60), wherein the C-shaped structure (60) comprises a first terminating end (51), a second terminating end (52), a mid-region (61) disposed between the first terminating end (51) and the second terminating end (52), a first indentation (71) disposed on the system first edge (101) at the mid-region (61), a second indentation (72) disposed on the system second edge (102) at the mid-region (61), wherein a first height (105) between the system first edge (101) and the system second edge (102) at the mid-region (61) is greater than a second height (106) between the system first edge (101) and the system second edge (102) at the first terminating end (51) or the second terminating end (52); and b. wrapping the synthetic neck muscle system (100) around a user's neck such that the skin-side memory foam layer (18) interfaces with the user's neck and the impact-absorbing layer (14) faces away from the user's neck, wherein the system first edge (101) is disposed proximal to the user's head and the system second edge (102) is distal to the user's head, wherein the mid-region (61) is disposed on a nape of the neck such that the first indentation (71) is directly proximal to an occiput of a user's head and the second indentation (72) is distal to the occiput, wherein the first terminating end (51) is disposed on a right lateral side of the user's neck and the second terminating end (52) is disposed on a left lateral side of the user's neck such that a throat of the user is positioned between the first terminating end (51) and the second terminating end (52);

wherein when 100 newtons of compression force is applied to the neck wearing the system (100), the system (100) effectively reduces neck displacement by 30% to 50% as compared to a neck without the system (100), wherein when 100 newtons of linear sheer force is applied to the neck wearing the system (100), the system (100) effectively reduces neck displacement by 25% to 45%, as compared to a neck without the system (100), wherein when 50 newton-meters of torsional sheer force is applied to the neck wearing the system (100), the system effectively reduces neck displacement by 10% to 30%, as compared to a neck without the system (100), and wherein when an impact having a mass of 2.7 kg and velocity of 3.0 m/sec is applied to a neck wearing the system (100), the system (100) effectively reduces a measured peak force by 30% to 50% and effectively increases a duration of time to reach the peak force by 180% to 200%, as compared to a neck without the system (100).

2. The method of claim 1, wherein the system (100) further comprises a tension and stabilizer strap (16) disposed at least partially on an impact-absorbing layer external surface (15) of the impact-absorbing layer (14).

3. The method of claim 1, wherein the system (100) further comprises an adjustable strap (24) disposed on the first terminating end (51) or the second terminating end (52).

4. The method of claim 3 further comprising connecting the first terminating end (51) and the second terminating end (52) by looping the adjustable strap (24) through an aperture of the terminating end opposite from the terminating end on which the adjustable strap is disposed such that the adjustable strap is positioned across the user's throat and aligned below an underside of a chin of the user.

5. A method of reducing impact forces and head and neck injuries, the method comprising:

a. providing a synthetic neck muscle system (100), the system (100) comprising:

i. a shell frame (12) comprising a shell frame first edge (31), a shell frame second edge (32), a shell frame first side surface (41), and a shell frame second side surface (42), wherein the shell frame (12) is formed in a C-shape; and ii. an impact-absorbing layer (14), wherein the impact-absorbing layer (14) is disposed on the shell frame first side surface (41), the impact-absorbing layer (14) having a core material (110) embedded therein, wherein the core material (110) comprises a foam material (160) and the fiber material (150), wherein a plurality of microspheres (170) are disposed within the foam material (160), wherein the impact-absorbing layer (14) is disposed continuously on the shell frame first side surface (41) from the shell frame first edge (31) to the shell frame second edge (32), wherein the impact-absorbing layer (14) is flushed with the shell frame first edge (31) to form a system first edge (101), wherein the impact-absorbing layer (14) is flushed with the shell frame second edge (32) to form a system second edge (102);

wherein the system (100) is molded into a C-shaped structure (60), wherein the C-shaped structure (60) comprises a first terminating end (51), a second terminating end (52), a mid-region (61) disposed between the first terminating end (51) and the second terminating end (52), a first indentation (71) disposed on the system first edge (101) at the mid-region (61), a second indentation (72) disposed on the system second edge (102) at the mid-region (61), wherein a first height (105) between the system first edge (101) and the system second edge (102) at the mid-region (61) is greater than a second height (106) between the system first edge (101) and the system second edge (102) at the first terminating end (51) or the second terminating end (52); and b. disposing the synthetic neck muscle system (100) on the user's neck.

6. The method of claim 5, wherein the system (100) further comprises a skin-side memory foam layer (18), wherein the skin-side memory foam layer (18) is disposed on the shell frame second side surface (42), wherein the skin-side memory foam layer (18) is disposed continuously on the shell frame second side surface (42) from the shell frame first edge (31) to the shell frame second edge (32).

7. The method of claim 6, wherein the skin-side memory foam layer (18) is flushed with the shell frame first edge (31) and the shell frame second edge (32).

8. The method of claim 6, wherein the system (100) is disposed on the user's neck such that the skin-side memory foam layer (18) interfaces with the user's neck and the impact-absorbing layer (14) faces away from the user's neck, wherein the system first edge (101) is disposed proximal to the user's head and the system second edge (102) is distal to the user's head, wherein the mid-region (61) is disposed on a nape of the neck such that the first indentation (71) is directly proximal to an occiput of a user's head and the second indentation (72) is distal to the occiput, wherein the first terminating end (51) is disposed on a right lateral side of the user's neck and the second terminating end (52) is disposed on a left lateral side of the user's neck such that a throat of the user is positioned between the first terminating end (51) and the second terminating end (52).

9. The method of claim 5, wherein the system (100) further comprises a tension and stabilizer strap (16) disposed at least partially on an impact-absorbing layer external surface (15) of the impact-absorbing layer (14).

10. The method of claim 5, wherein the system (100) further comprises an adjustable strap (24) disposed on the first terminating end (51) or the second terminating end (52).

11. The method of claim 10 further comprising connecting the first terminating end (51) and the second terminating end (52) by looping the adjustable strap (24) through an aperture of the terminating end opposite from the terminating end on which the adjustable strap is disposed such that the adjustable strap is positioned across a throat of the user and aligned below an underside of a chin of the user.

12. The method of claim 5, wherein the shell frame (12) has embedded therein a shell material (120), wherein the shell material (120) comprises a putty material (180) and a fiber material (150).

13. A method of reducing impact forces and head and neck injuries, the method comprising:

a. providing a synthetic neck muscle system (100), the system (100) comprising:

i. a shell frame (12) comprising a shell frame first edge (31), a shell frame second edge (32), a shell frame first side surface (41), and a shell frame second side surface (42), wherein the shell frame (12) is formed in a C-shape, wherein the shell frame has a shell material (120) embedded therein, wherein the shell material (120) comprises a putty material (180) and a fiber material (150); and ii. an impact-absorbing layer (14), wherein the impact-absorbing layer (14) is disposed on the shell frame first side surface (41), the impact-absorbing layer (14) having a core material (110) embedded therein, wherein the core material (110) comprises a foam material (160) and the fiber material (150), wherein a plurality of microspheres (170) are disposed within the foam material (160), wherein the impact-absorbing layer (14) is disposed continuously on the shell frame first side surface (41) from the shell frame first edge (31) to the shell frame second edge (32) such that the core material (110) is bonded to the shell material (120), wherein the impact-absorbing layer (14) is flushed with the shell frame first edge (31) to form a system first edge (101), wherein the impact-absorbing layer (14) is flushed with the shell frame second edge (32) to form a system second edge (102);

wherein the system (100) is molded into a C-shaped structure (60), wherein the C-shaped structure (60) comprises a first terminating end (51), a second terminating end (52), a mid-region (61) disposed between the first terminating end (51) and the second terminating end (52), a first indentation (71) disposed on the system first edge (101) at the mid-region (61), a second indentation (72) disposed on the system second edge (102) at the mid-region (61), wherein a first height (105) between the system first edge (101) and the system second edge (102) at the mid-region (61) is greater than a second height (106) between the system first edge (101) and the system second edge (102) at the first terminating end (51) or the second terminating end (52); and b. disposing the synthetic neck muscle system (100) on the user's neck.

14. The method of claim 13, wherein the system (100) further comprises a skin-side memory foam layer (18), wherein the skin-side memory foam layer (18) is disposed on the shell frame second side surface (42), wherein the skin-side memory foam layer (18) is disposed continuously on the shell frame second side surface (42) from the shell frame first edge (31) to the shell frame second edge (32).

15. The method of claim 14, wherein the skin-side memory foam layer (18) is flushed with the shell frame first edge (31) and the shell frame second edge (32).

16. The method of claim 14, wherein the system (100) is disposed on the user's neck such that the skin-side memory foam layer (18) interfaces with the user's neck and the impact-absorbing layer (14) faces away from the user's neck, wherein the system first edge (101) is disposed proximal to the user's head and the system second edge (102) is distal to the user's head, wherein the mid-region (61) is disposed on a nape of the neck such that the first indentation (71) is directly proximal to an occiput of a user's head and the second indentation (72) is distal to the occiput, wherein the first terminating end (51) is disposed on a right lateral side of the user's neck and the second terminating end (52)

is disposed on a left lateral side of the user's neck such that a throat of the user is positioned between the first terminating end (51) and the second terminating end (52).

17. The method of claim 13, wherein the system (100) further comprises a tension and stabilizer strap (16) disposed at least partially on an impact-absorbing layer external surface (15) of the impact-absorbing layer (14).

18. The method of claim 13, wherein the system (100) further comprises an adjustable strap (24) disposed on the first terminating end (51) or the second terminating end (52).

19. The method of claim 18 further comprising connecting the first terminating end (51) and the second terminating end (52) by looping the adjustable strap (24) through an aperture of the terminating end opposite from the terminating end on which the adjustable strap is disposed such that the adjustable strap is positioned across a throat of the user and aligned below an underside of a chin of the user.

* * * * *